United States Patent [19]

Wilks

[11] 4,378,849

[45] Apr. 5, 1983

[54] BLOWOUT PREVENTER WITH MECHANICALLY OPERATED RELIEF VALVE

[76] Inventor: Joe A. Wilks, P.O. Box 45085, Baton Rouge, La. 70895

[21] Appl. No.: 238,829

[22] Filed: Feb. 27, 1981

[51] Int. Cl.[3] ..... E21B 33/06

[52] U.S. Cl. ..... 166/369; 166/95; 251/1 R; 137/862

[58] Field of Search ..... 166/369, 95, 97, 88, 166/53; 251/1 R, 1 B, 1 A; 137/862, 865, 869, 872, 883, 885

[56] References Cited

U.S. PATENT DOCUMENTS

| | | | |
|---|---|---|---|
| 134,348 | 12/1872 | Birkinbine | 137/869 X |
| 662,732 | 11/1900 | McLeish | 137/862 X |
| 1,285,267 | 11/1918 | Lund | 137/862 X |
| 2,188,141 | 1/1940 | Abercrombie | 166/14 |
| 2,609,836 | 8/1946 | Knox | 251/1 B |
| 3,589,667 | 6/1971 | Lewis | 251/1 |
| 4,098,341 | 7/1978 | Lewis | 166/314 |
| 4,098,516 | 7/1978 | Murman | 277/235 R |
| 4,192,379 | 3/1980 | Kennedy, Jr. | 166/250 |
| 4,317,557 | 3/1982 | Orr | 251/1 A |

OTHER PUBLICATIONS

Hydril R Company, Catalog No. 792, copyrighted in 1979, on p. 24.

*Primary Examiner*—Ernest R. Purser
*Assistant Examiner*—Thuy M. Bui
*Attorney, Agent, or Firm*—David L. Ray

[57] ABSTRACT

A blowout preventer having a mechanical linkage to a valve connected to a pressure relief line in the casing beneath the blowout preventer whereby the valve on the pressure relief line is opened when the blowout preventer is actuated is disclosed. The blowout preventer includes an upright tubular body having an annular packing therein which can be constructed about a drill pipe or other pipe in the well, a head connected to the top of the upright tubular body for containing the annular packing in the body, a piston slidably received in the body and adapted to selectively constrict the packing about the well pipe, a casing pipe connected to the lower end of the body for containing the well pipe, a pressure relief line connected to the casing having a valve therein, and a rod connected to the piston and the valve to open the valve when the piston slides within the tubular body to constrict the packing about the well pipe.

9 Claims, 2 Drawing Figures

BLOWOUT PREVENTER WITH MECHANICALLY OPERATED RELIEF VALVE

BACKGROUND OF THE INVENTION

The present invention is related to oil and gas well blowout prevention. More particularly, the invention is related to actuating relief valves in conjunction with the actuation of blowout preventers.

Oil and gas well blowout preventers are constructed to close about a pipe in a well in order to block the upward flow of fluids from the well in the open space between the casing and drill pipe hole during drilling and completion operations.

Blowout preventers are well known in the art. Examples of blowout preventers and blowout preventer components are contained in the following U.S. Pat. Nos. 2,188,141; 3,589,667; 4,098,341; 4,098,516; and 4,192,379.

It is also known in the art to insert a pressure relief line beneath the blowout preventer in the casing to allow some of the fluids trapped in the space between the drill pipe and the casing when the blowout preventer is actuated to escape to the atmosphere or to some reservoir. Such a pressure relief line has a valve therein which may be opened and closed to selectively release fluids through the pressure relief line. The valve on a pressure line is commonly operated by hydraulic lines which actuate the valve when pressure on the blowout preventer is sufficiently high. The pressure relief line must be opened rapidly or the blowout preventer may explode, endangering the lives of the personnel operating the well and destroying equipment adjacent thereto. If the hydraulic system operating the valve on the pressure relief line should fail for any means, such an explosion can occur.

THE INVENTION

In accordance with the present invention there is provided a blowout preventer which has a mechanical linkage to a valve connected to a pressure relief line in the casing beneath the blowout preventer whereby the valve on the pressure relief line is opened when the blowout preventer is actuated. A preferred blowout preventer of the invention includes an upright tubular body having an annular packing therein which can be constricted about a drill pipe or other pipe in the well, a head connected to the top of the upright tubular body for containing the annular packing in the body, a piston slidably received in the body and adapted to selectively constrict the packing about the well pipe, a casing pipe connected to the lower end of the body for containing the well pipe, a pressure relief line connected to the casing having a valve therein, and a rod connected to the piston and the valve to open the valve when the piston slides within the tubular body to constrict the packing about the well pipe.

An advantage of the present invention is that a pressure relief valve controlling the flow of fluids from the area between the well pipe and the casing beneath the blowout preventer is opened automatically when the blowout preventer is actuated. A further advantage is that the pressure relief valve is mechanically actuated and thus there can be no failure due to leaks or blockages in the hydraulic lines. A further advantage is that explosions are less likely because the blowout preventer cannot be actuated without a pressure relief valve being opened to allow fluids to escape from the area between the drill pipe and casing.

DESCRIPTION OF THE PREFERRED EMBODIMENTS

Figure 1:
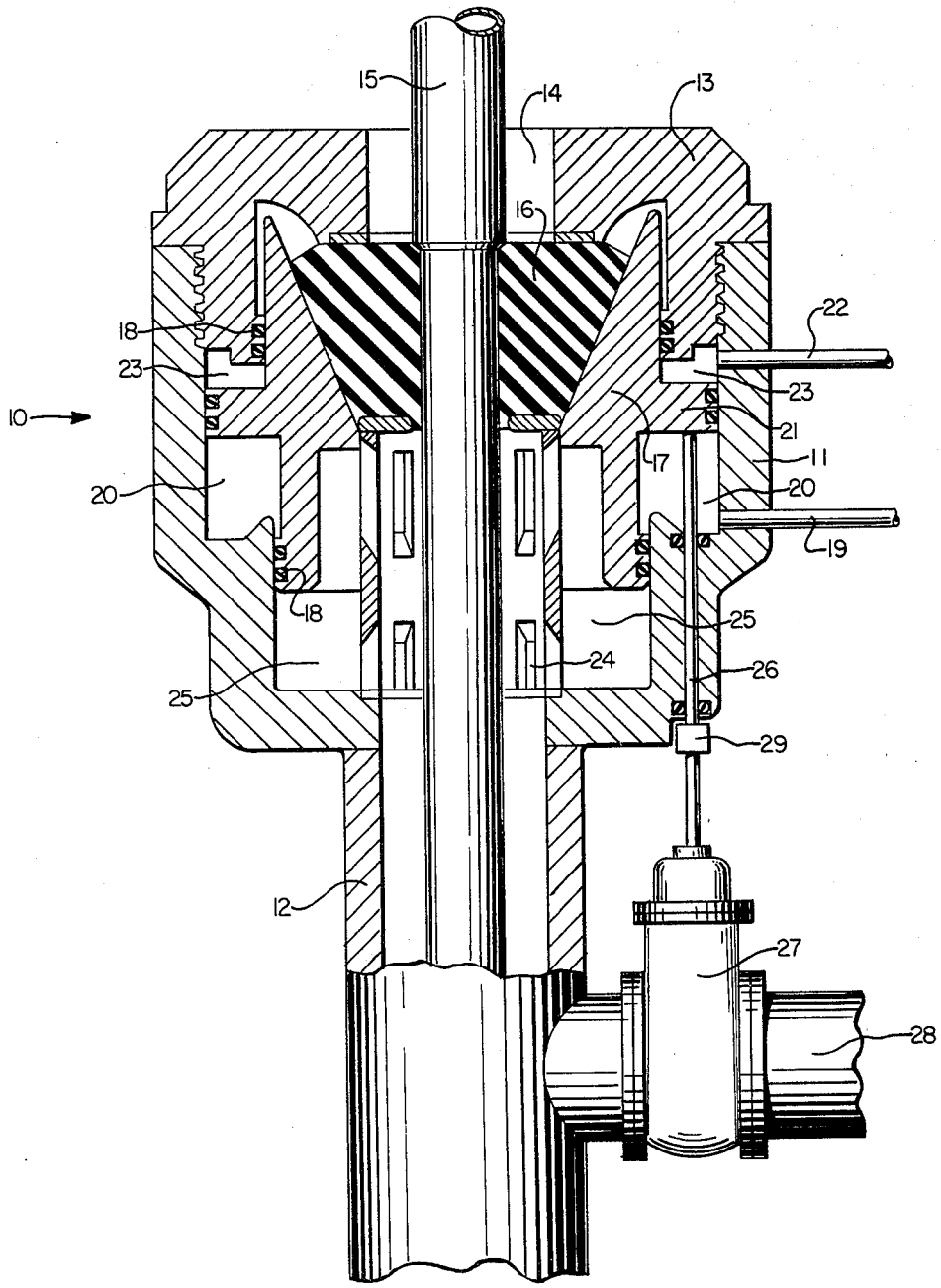
FIG. 1 is a partly cross-sectional, partly cut-away view of the invention showing the blowout preventer in the actuated condition.

Referring now to the drawings, in FIG. 1 there is shown a blowout preventer generally indicated by the numeral 10. Portions of blowout preventer 10 are similar to those of a conventional blowout preventer such as that manufactured by the Hydril® Company, Los Angeles, Calif., and described in their catalog No. 792, copyrighted in 1979, on Page 24 thereof. The conventional blowout preventer includes a body member 11 which is circular in cross-section and has a series of cylindrical cavities inside. A pipe commonly referred to as a casing is connected to the lower end of the blowout preventer by any suitable means such as welding, bolts, or the like, and is indicated by the numeral 12. At the upper end of the blowout preventer 10 is a head 13 which is shown threaded at the top of the blowout preventer. The head has an opening 14 therein for receipt of well pipe 15 which may be a drill pipe or any other type of well pipe.

Figure 2:
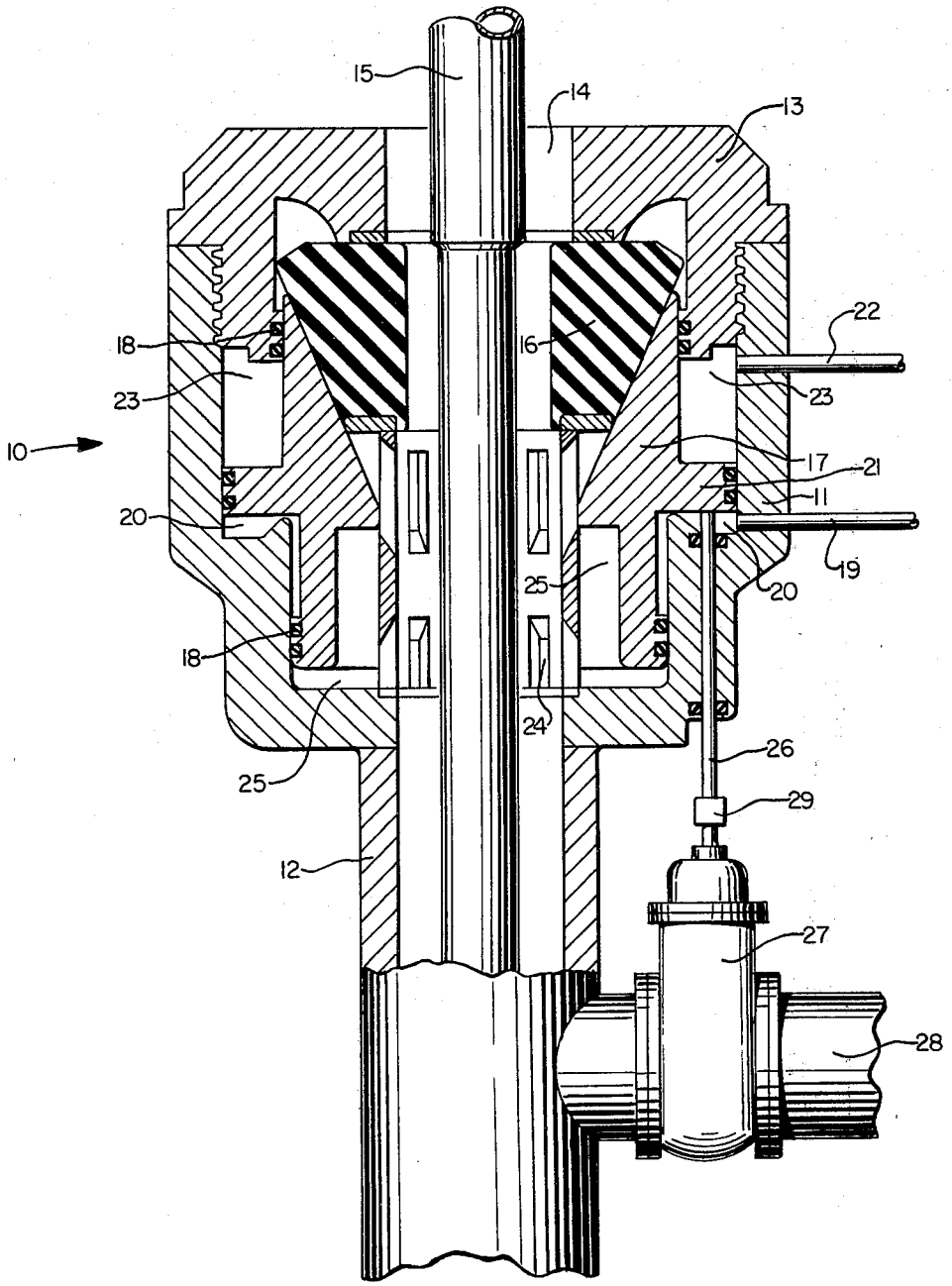
FIG. 2 is a partly cross-sectional, partly cut-away view of the invention showing the blowout preventer in the unactuated or opened condition.

A packing 16 is shown in FIG. 1 to be compressed about well pipe 15 and in FIG. 2 to be in the unactuated or released position whereby fluids can flow around the outside of the pipe upwardly. Beneath packing 16 is piston 17. Piston 17 slides upwardly and downwardly within body 11. A series of seals 18 prevent leakage at the various points at which piston 17 contacts body member 11 or head 13.

To force piston 17 upwardly and downwardly there is a line 19 connected to chamber 20 beneath the center lip 21 of piston 17. Hydraulic fluid or air can be forced to fill chamber 20 after line 22 has been opened to force piston 17 upwardly against packing 16. To force the piston downwardly into its normal open position, fluids can be forced through line 22 to chamber 23 after line 19 is opened. Thus the packing 16 is released from around pipe 15. Vents or openings 24 are formed in the lower end of tubular body 11 which allows the pressure from the gas or fluid inside the casing between the drill pipe and the casing to enter chamber 25 and assist in forcing piston 17 upwardly onto packing 16 after piston 17 has initially forced packing 16 to constrict around pipe 15.

In accordance with applicant's invention, a rod 26 is connected to lip 21 of piston 17 so that when piston 17 travels upwardly, valve 27 is opened. Valve 27 is connected to pressure relief or diverter line or pipe 28 which in turn is connected to casing 12. Pressure relief line 28 allows fluids contained in the space between the outside of the well pipe 15 and the inside of casing 12 to be released to a location remote from the casing through pressure relief line 28 when the blowout preventer is actuated and the packing 16 is sealed against well pipe 15. Thus explosions due to high pressure surges are less likely.

As can be seen in FIG. 2, when the piston 17 is in the unactuated or down position rod 26 is forced downwardly to thereby close gate valve 27. If desired a coupling 29 may be connected to rod 26 so that the rod may be disconnected from the gate valve to allow the gate valve to be opened independently of the actuation of the blowout preventer.

It will be understood that the particular construction is not essential to the present invention. All that is necessary to practice the present invention is to have a piston or other slidable member of the blowout preventer which moves upwardly or downwardly when the blowout preventer is actuated and to which a mechanical linkage may be made with the pressure relief valve 27 to open valve 27 when the blowout preventer is actuated. Furthermore, various types of mechanical linkages may be used other than that specifically shown in the drawing, and a mechanical linkage may be attached to any portion of a movable member such as piston 17.

Having fully described the preferred embodiments of the present invention, it is desired that it be limited only within the spirit and scope of the present claims.

What is claimed is:

1. A blowout preventor for use on a well comprising:

a. a body member adapted for containing a well pipe and means for selectively preventing fluid from the bottom of the well pipe through said body members;

b. a casing connected to the bottom of the body means, said casing having a pressure relief line connected thereto, said pressure relief line comprising a pipe connected to said casing for diverting fluids contained in said casing to a location remote from said casing having a valve therein; and c. means for mechanically linking said valve to said means for selectively preventing fluid from the bottom of the well from flowing around the outside of the well through said body member so that said valve is opened when the flow of fluids around the outside of the well pipe through said body member is prevented.

2. The blowout preventer of claim 1 wherein said valve is a gate valve.

3. The blowout preventer of claim 1 wherein said means for selectively preventing fluid from the bottom of the well from flowing around the outside of the well pipe comprises a packing means and a piston means slidable upwardly and downwardly about said well pipe which can compress said packing means around the outside of said well pipe to prevent the flow of fluids around the outside of said well pipe upwardly through said body member.

4. The blowout preventer of claim 3 wherein rod means is connected to said piston means and to said valve means for opening said valve means when said piston means compresses said packing means.

5. A blowout preventer for use on a well comprising:

a. an upright tubular body means adapted to receive an annular packing means to be constricted about a well pipe;

b. an annular packing means located in said body means;

c. a head means connected to the top of said body means for containing said packing means in said body means;

d. piston means slidably received in said body means adapted to selectively constrict said packing means about a well pipe extending through said body means;

e. casing pipe means connected to the lower end of said body means;

f. diverter pipe means connected to said casing pipe means for diverting fluids contained in said casing to a location remote from said casing pipe means;

g. valve means connected to said diverter pipe means; and h. rod means connected to said piston means to open said valve means when said piston means constricts said packing means.

6. The blowout preventer of claim 5 wherein said valve means is a gate valve.

7. The blowout preventer of claim 5 wherein said body means contains means for selectively forcing said piston means against said packing means to constrict said packing means around said well pipe.

8. The blowout preventer of claim 7 wherein said head means has a cylindrical hole in the top thereof through which said well pipe is received.

9. A method for preventing blowouts in a well comprising:

a. attaching a blowout preventer having a movable flow restricting means therein to a well casing pipe;

b. connecting a pressure relief pipe to the casing pipe between the blowout preventer and the bottom of the well, said pressure relief line having a valve therein; and c. mechanically linking said movable internal flow restricting means of the blowout preventer to said valve so that said valve is opened when said blowout preventer is actuated.

* * * * *